US006837207B2

(12) United States Patent
Bonde et al.

(10) Patent No.: US 6,837,207 B2
(45) Date of Patent: Jan. 4, 2005

(54) INVERTED CRANKCASE WITH ATTACHMENTS FOR AN INTERNAL COMBUSTION ENGINE

(75) Inventors: Kevin G. Bonde, Kiel, WI (US); Terrence M. Rotter, Sheboygan Falls, WI (US)

(73) Assignee: Kohler Co., Kohler, WI (US)

( * ) Notice: Subject to any disclaimer, the term of this patent is extended or adjusted under 35 U.S.C. 154(b) by 28 days.

(21) Appl. No.: 10/198,788

(22) Filed: Jul. 18, 2002

(65) Prior Publication Data

US 2004/0011318 A1 Jan. 22, 2004

(51) Int. Cl.[7] ..... F02F 7/00

(52) U.S. Cl. ..... 123/195 HC; 123/196 R; 123/196 W

(58) Field of Search ..... 123/196 R, 196 W, 123/195 HC

(56) References Cited

U.S. PATENT DOCUMENTS

| | | | |
|---|---|---|---|
| 1,172,612 | A | 2/1916 | Kremer |
| 1,301,007 | A | 4/1919 | Roof |
| 1,410,019 | A | 3/1922 | Krause |
| 1,469,063 | A | 9/1923 | Wills |
| 1,590,073 | A | 6/1926 | Birkigt |
| 1,684,955 | A | 9/1928 | Goodwin |
| 2,235,160 | A | 3/1941 | Ljungstrom |
| 2,459,594 | A | 1/1949 | Smith |
| 3,118,433 | A | 1/1964 | Lechtenberg |
| 3,195,526 | A | 7/1965 | Jordan |
| 3,200,804 | A | 8/1965 | Hensler et al. |
| 3,314,408 | A | 4/1967 | Fenton |
| 3,407,741 | A | 10/1968 | Weber et al. |
| 3,457,804 | A | 7/1969 | Harkness |
| 3,561,416 | A | 2/1971 | Kiekhaefer |
| 3,751,080 | A | 8/1973 | Bailey et al. |

(List continued on next page.)

FOREIGN PATENT DOCUMENTS

| | | |
|---|---|---|
| DE | 3120190 A1 | 5/1982 |
| GB | 355365 | 8/1931 |
| GB | 378216 | 8/1932 |
| WO | WO 86/04122 A1 | 7/1986 |
| WO | WO 00/43655 A1 | 7/2000 |

OTHER PUBLICATIONS

"Technical Innovations–Briggs & Stratton extends engine life", SAE Off–Highway Engineering, Oct. 2001, p. 4.

Ten photographs of Kawasaki FJ180V engine, taken in Apr., 2004 (the first nine photos) and 2003 (the final photo).

*Primary Examiner*—Noah P. Kamen
(74) *Attorney, Agent, or Firm*—Quarles & Brady LLP

(57) ABSTRACT

A crankcase, and method of assembling a crankcase, of an internal combustion engine are disclosed. The crankcase includes a top including at least a first portion of a top surface of the crankcase, and a bottom including a bottom surface of the crankcase and a plurality of side surfaces of the crankcase. The side surfaces are substantially vertical and extend between the top and bottom surfaces. The crankcase further includes bearings within at least one of the top and bottom to support a crankshaft. The crankcase additionally includes a first interface at which at least one of the top, bottom and side surfaces is coupled to a cylinder. The bottom and top interface one another along a split line, the top is removable from the bottom, and the top is configured to be attached to at least one of an oil filter component, a starter, and an ignition module.

22 Claims, 6 Drawing Sheets

U.S. PATENT DOCUMENTS 3,818,577 A 6/1974 Bailey et al.
4,030,179 A 6/1977 Schwarz
4,097,702 A 6/1978 Halsted
4,185,717 A 1/1980 Ford, Jr. et al.
4,193,310 A 3/1980 Boyer et al.
4,198,879 A 4/1980 Hornak et al.
4,283,607 A 8/1981 Brightman
4,285,309 A 8/1981 Johansson
4,308,830 A 1/1982 Yamada et al.
4,332,222 A 6/1982 Papez
4,336,777 A 6/1982 Yanagihara et al.
4,366,787 A 1/1983 Gale
4,372,258 A 2/1983 Iwai
4,380,216 A 4/1983 Kandler
4,391,231 A 7/1983 TateBe et al.
4,401,067 A 8/1983 Honda
4,414,934 A 11/1983 Vogl et al.
4,422,348 A 12/1983 Campbell
4,433,651 A 2/1984 Nakakita et al.
4,446,828 A 5/1984 Bauder et al.
4,452,194 A 6/1984 Watanabe
4,458,555 A 7/1984 Holtzberg et al.
4,507,917 A 4/1985 Kandler
4,510,897 A 4/1985 Hatz et al.
4,530,318 A 7/1985 Semple
4,534,241 A 8/1985 Remmerfelt et al.
4,548,253 A 10/1985 Funatani et al.
4,569,109 A 2/1986 Fetouh
4,570,584 A 2/1986 Uetsuji et al.
4,617,122 A 10/1986 Kruse et al.
4,622,933 A 11/1986 Fukuo et al.
4,644,912 A 2/1987 Umeha et al.
4,656,981 A 4/1987 Murata et al.
4,660,512 A 4/1987 Binder et al.
4,672,930 A 6/1987 Sumi
4,674,455 A 6/1987 Tsuboi
4,684,267 A 8/1987 Fetouh
4,688,446 A 8/1987 Ishikawa
4,691,590 A 9/1987 Geringer et al.
4,696,266 A 9/1987 Harada
4,711,823 A 12/1987 Shiina
4,716,861 A 1/1988 Fujikawa et al.
4,736,717 A 4/1988 Fujikawa et al.
4,793,297 A 12/1988 Fujii et al.
4,802,269 A 2/1989 Mukai et al.
4,811,705 A 3/1989 Ono et al.
4,819,592 A 4/1989 van Ligten
4,819,593 A 4/1989 Bruener et al.
4,822,414 A 4/1989 Yoshikawa et al.
4,828,632 A 5/1989 Adam et al.
4,834,784 A 5/1989 Bidanset
4,836,045 A 6/1989 Lobig
4,838,909 A 6/1989 Bidanset
4,853,179 A 8/1989 Shiina
4,862,981 A 9/1989 Fujikawa et al.
4,867,806 A 9/1989 Shiina
4,890,584 A 1/1990 Tamba et al.
4,892,068 A 1/1990 Coughlin
4,898,133 A 2/1990 Bader
4,909,197 A 3/1990 Perr
4,926,814 A 5/1990 Bonde
4,928,550 A 5/1990 Sakai et al.
4,928,651 A 5/1990 Kronich
4,934,442 A 6/1990 Futamura et al.
4,949,687 A 8/1990 Emmersberger
4,958,537 A 9/1990 Diehl et al.
4,964,378 A 10/1990 Tamba et al.
4,986,224 A 1/1991 Zuffi
5,002,023 A 3/1991 Butterfield et al.
5,038,727 A 8/1991 Burns et al.
5,057,274 A 10/1991 Futamura et al.
5,065,720 A 11/1991 Nishiyama et al.
5,067,933 A 11/1991 Hardesty et al.
5,085,184 A 2/1992 Yamada et al.
RE33,978 E 6/1992 Shirai
5,152,264 A 10/1992 Evans
5,163,341 A 11/1992 Murrish et al.
5,197,422 A 3/1993 Oleksy et al.
5,197,425 A 3/1993 Santi
5,207,120 A 5/1993 Arnold et al.
5,241,873 A 9/1993 Hormann
5,243,878 A 9/1993 Santi
5,265,700 A 11/1993 Santi
5,282,397 A 2/1994 Harkness et al.
5,323,745 A 6/1994 Sato et al.
5,357,917 A 10/1994 Everts
5,370,093 A 12/1994 Hayes
5,375,571 A 12/1994 Diehl et al.
5,421,297 A 6/1995 Tamba et al.
5,463,809 A 11/1995 Hoffman et al.
5,497,735 A 3/1996 Kern et al.
5,555,776 A 9/1996 Gazza
5,556,441 A 9/1996 Courtwright et al.
5,560,333 A 10/1996 Genouille
5,606,943 A 3/1997 Tamba et al.
5,615,586 A 4/1997 Phillips et al.
5,640,936 A * 6/1997 Hudson ..... 123/196 W
5,651,336 A 7/1997 Rygiel et al.
5,711,264 A 1/1998 Jezek et al.
5,722,295 A 3/1998 Sakai et al.
5,809,958 A 9/1998 Gracyalny
5,823,153 A 10/1998 Santi et al.
5,863,424 A 1/1999 Lee
5,887,678 A 3/1999 Lavender
5,904,124 A 5/1999 Poehlman et al.
5,934,960 A 8/1999 Katayama et al.
5,960,763 A 10/1999 Yamamura
5,964,198 A 10/1999 Wu
5,979,392 A 11/1999 Moorman et al.
5,988,135 A 11/1999 Moorman et al.
6,006,721 A 12/1999 Shannon et al.
6,047,667 A 4/2000 Leppanen et al.
6,055,952 A 5/2000 Gau
6,056,874 A * 5/2000 Goodman ..... 210/248
6,076,426 A 6/2000 Genouille
6,109,230 A 8/2000 Watanabe et al.
6,116,205 A 9/2000 Troxler et al.
6,126,499 A 10/2000 Katayama et al.
6,170,449 B1 1/2001 Saiki et al.
6,213,081 B1 4/2001 Ryu et al.
6,269,786 B1 8/2001 Snyder et al.
6,293,981 B1 9/2001 Holderle et al.
6,305,242 B1 10/2001 Smith et al.
6,395,049 B2 5/2002 Knodler et al.
6,422,193 B2 7/2002 Kawamoto
6,435,154 B1 8/2002 Simpson et al.

* cited by examiner

INVERTED CRANKCASE WITH ATTACHMENTS FOR AN INTERNAL COMBUSTION ENGINE

FIELD OF THE INVENTION

The present invention relates to internal combustion engines. In particular, the present invention relates to the crankcases of vertical cylinder internal combustion engines, such as those employed in lawn mowers and a variety of other machines.

BACKGROUND OF THE INVENTION

Many internal combustion engines, and particularly many single cylinder internal combustion engines, employ crankcases that have a bottom side or floor that is removable from the remainder of the respective crankcase. In vertical crankshaft engines of this type, each of the top side and the bottom side of the crankcase includes a bearing for the crankshaft of the engine. The removable bottom side commonly operates as an oil pan, or collecting bin, for oil within the crankcase.

Although commonly employed, this crankcase design has certain limitations. The split line of the crankcase is between the side walls of the crankcase and its bottom side, at a low level that is often below the oil sump level and near or at the level at which oil is collecting within the crankcase. Consequently, it is not uncommon that the crankcase will leak oil along the split line. This is particularly the case as the engine ages due to normal wear and tear, or after the bottom side has repeatedly been removed and then put back onto the crankcase.

Additionally, the oil filter in such conventional crankcases is typically positioned in a low position as part of, or close to, the removable bottom side of the crankcase. This positioning of the oil filter makes it difficult to service the oil filter and, in particular, makes it difficult to service the oil filter without spilling oil. Often the designs of such oil filters is such that the mere opening of the oil filters allows oil to spill out of the oil filters. For example, many oil filters are horizontally mounted on the crankcase such that opening of an oil filter requires removing a right side portion of the oil filter from a left side portion of the oil filter. Once the seal between the right and left side portions of the oil filter is broken, oil can spill out of the oil filter. Even where the oil filters are vertically mounted on the crankcase such that opening of an oil filter requires removing a top portion of the oil filter from a bottom portion of the oil filter, the seal between the top and bottom portions is proximate the bottom edge of the oil filter (which often is along the floor of the crankcase). Consequently, opening of the oil filter requires removing the top portion even though most of the latent oil within the filter is within that top portion, and thus oil leaks from the oil filter as soon as the seal between the top and bottom portions is broken.

Further, it is common that the equipment driven by the engine is coupled to the engine (and engine crankshaft) along the bottom of the engine. Because in the above-described engines it is necessary to remove the bottom side of the engine in order to change the oil filter and/or otherwise open the engine, it also is necessary to remove the equipment on which the engine is mounted in order to perform such operations.

Additionally, conventional engines often have an electric starter mechanism that is coupled to the crankcase of the engine by way of an L-bracket or other structure. Such a manner of coupling is relatively expensive to implement insofar as a separate coupling element (e.g., the L-bracket) must be provided, and insofar as assembly of the engine requires assembling the electric starter, L-bracket and crankcase to one another.

Also, conventional engines usually employ an ignition module that provides electrical power to a spark plug of the engine. Commonly, the ignition module receives electrical energy from the relative rotation of a magnet on a flywheel (or other rotating member) of the engine with respect to a stationary magnet attached to the engine. The ignition module is typically positioned on the cylinder of the engine itself. This, however, can be disadvantageous insofar as the cylinder is typically the hottest portion of the engine during operation of the engine, which can adversely affect performance of the ignition module.

Further, conventional engines must provide lubricant to the crankshaft bearings and camshaft bearings within the engine. In vertical crankshaft engines, at least certain of these bearings are positioned proximate the top of the engine, such that oil must be communicated upward to these elements. Commonly the oil is communicated by way of channels in the crankcase, which are typically formed either by drilling or casting tubes within the crankcase. While such channels adequately deliver oil where it is needed within the crankcase, the drilling or casting of such channels is often costly to perform.

Given these various design problems associated with conventional engines, it would be advantageous if an improved engine configuration was designed that would reduce the likelihood of oil leakage from the crankcase, would facilitate the servicing of the oil filter of the engine, and would further facilitate the accessing of the interior of the engine without the removal of equipment attached to the crankshaft. Additionally, it would be advantageous if such an improved engine design also facilitated the mounting of a starter on the engine, reduced the amount of heat experienced by the ignition module of the engine, and could be implemented to include oil channels without requiring expensive drilling or casting processes to form those channels.

SUMMARY OF THE INVENTION

The present inventors have realized that the crankcase for a single cylinder, vertical crankshaft internal combustion engine can be designed in an inverted manner in which a top side or roof of the crankcase is removable from the remainder of the crankcase, rather than the bottom side or floor of the crankcase. With this inverted configuration, internal parts of the engine are more easy to access and service, without removing the engine from equipment on which it is mounted, simply by removing the top of the engine. Additionally, the crankcase is unlikely to leak oil along the split line between the top side of the crankcase and the remainder of the crankcase.

The inventors have further realized that, with such an inverted crankcase design, the design of other components of the engine can also be improved. In one embodiment, the oil filter is attached to the removable top side of the engine, and consequently is more easily serviced and also can be entirely removed along with the top side. Further, the oil filter is designed so that its top portion is integrally formed as part of the top side of the crankcase. The seal between the top portion and bottom portion of the oil filter is proximate the top side of the crankcase so that most of the latent oil of the oil filter resides in its bottom portion. Consequently, opening of the oil filter, which involves removing the bottom portion, does not result in significant oil leakage.

Additionally, in this embodiment, the top side of the crankcase includes a mounting flange, to which an electric starter of the engine can be mounted without use of any L-bracket. Further, the top side of the crankcase includes bosses by which an ignition module of the engine is coupled to the top side of the crankcase proximate to, but not in contact with, the cylinder. By coupling the top side of the crankcase to the remainder of the crankcase by way of a gasket, heat transfer from the cylinder to the top side of the crankcase, and thus to the ignition module, is limited.

In particular, the present invention relates to a crankcase of an internal combustion engine. The crankcase includes a top including at least a first portion of a top surface of the crankcase, and a bottom including a bottom surface of the crankcase and a plurality of side surfaces of the crankcase. The side surfaces are substantially vertical and configured to extend between the top surface and the bottom surface. The crankcase further includes first and second bearings within at least one of the top and bottom, where the first and second bearings are configured to support a crankshaft. The crankcase additionally includes a first interface along at least one of the top surface, the bottom surface and the side surfaces at which the at least one surface is coupled to a first cylinder. The bottom and top interface one another along a split line, the top is removable from the bottom, and the top is configured to be attached to at least one of an oil filter component, a starter, and an ignition module.

The present invention additionally relates to an internal combustion engine. The internal combustion engine includes a crankshaft including first and second main portions, a crank pin, and first and second crank arms coupling the crank pin to the first and second main portions, respectively. The internal combustion engine further includes a cylinder head, a cylinder coupled to the cylinder head, and a piston positioned within the cylinder and coupled to the crank pin by a connecting rod. The internal combustion engine additionally includes an additional engine component including at least one of an oil filter component, a starter, and an ignition module. The internal combustion engine further includes a bottom portion of a crankcase, where the bottom portion includes at least one bearing for supporting the crankshaft and is further coupled to the cylinder. The internal combustion engine further includes removable means for encasing at least a portion of the crankshaft, where the removable means is capable of being attached to the bottom portion, and where the additional engine component is attached to the removable means.

The present invention further relates to a method of assembling a crankcase of an internal combustion engine. The method includes providing a bottom of a crankcase coupled to a cylinder, where a piston is positioned within the cylinder, a crankshaft is supported by the bottom of the crankcase, and the piston is coupled to the crankshaft by a connecting rod. The method additionally includes affixing a top of the crankcase to the bottom of the crankcase, where the top includes at least a first portion of a top surface of the crankcase, and where the bottom of the crankcase includes a bottom surface of the crankcase and at least one side surface of the crankcase. The method further includes attaching at least one of an oil filter component, a starter and an ignition module to the top of the crankcase.

The present invention additionally relates to an oil filter. The oil filter includes a top portion and a cup-like bottom portion. The top portion and bottom portion are assembled to one another along a substantially-horizontal seam. Most oil within the oil filter resides within the bottom portion so that detachment of the bottom portion from the top portion along the seam does not result in significant oil leakage.

DETAILED DESCRIPTION OF THE PREFERRED EMBODIMENT

Figure 1:
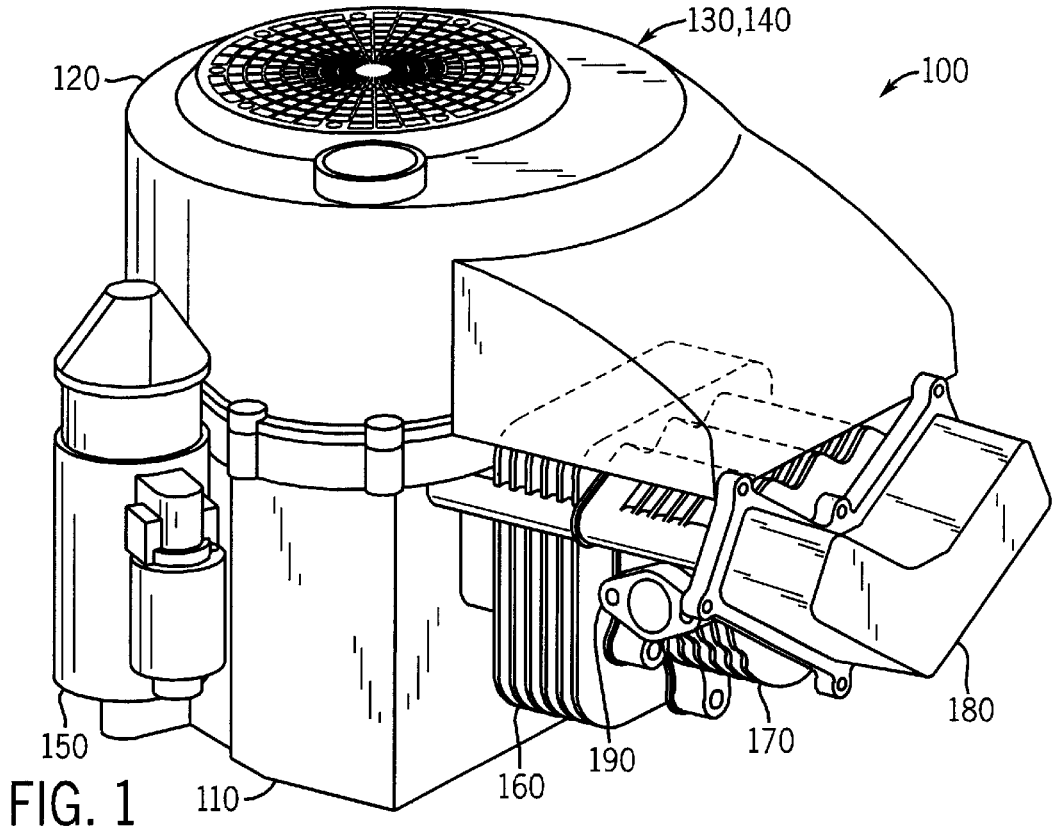
FIG. 1 is a first perspective view of a single cylinder engine, taken from a side of the engine on which are located a starter and cylinder head.
Figure 2:
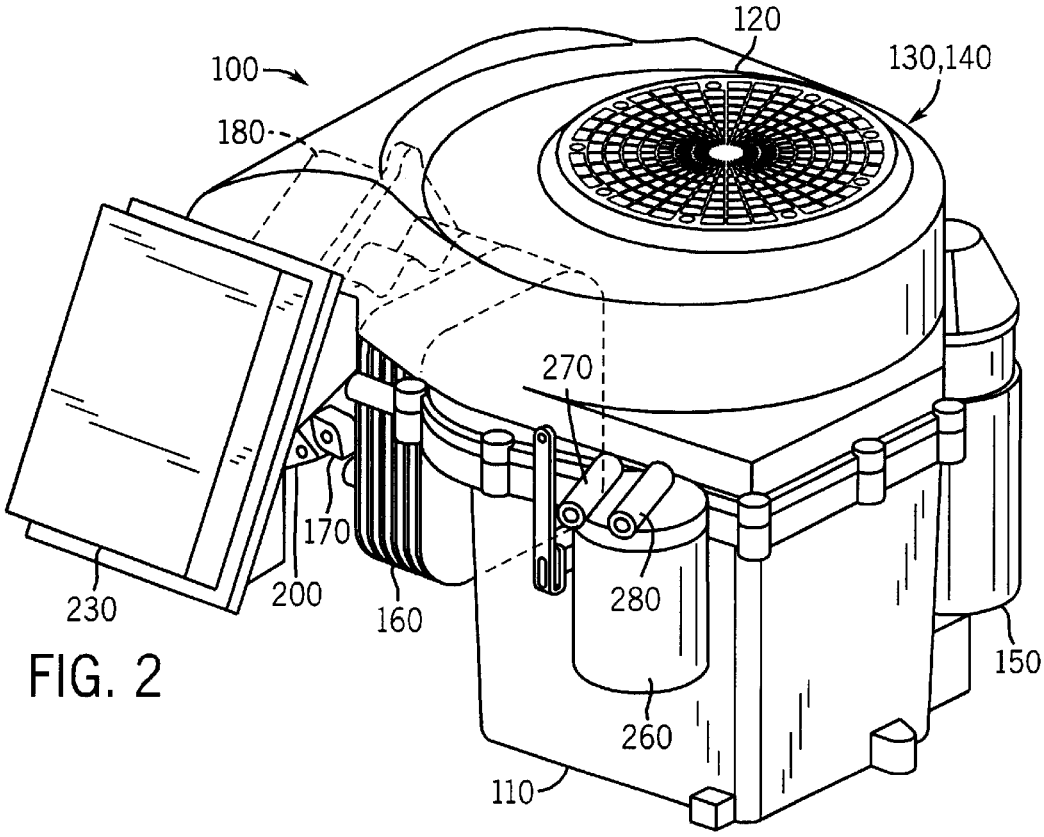
FIG. 2 is a second perspective view of the single cylinder engine of FIG. 1, taken from a side of the engine on which are located an air cleaner and oil filter.

Referring to FIGS. 1 and 2, a new single cylinder, 4-stroke, internal combustion engine 100 designed by Kohler Co. of Kohler, Wis. includes a crankcase 110 and a blower housing 120, inside of which are a fan 130 and a flywheel 140. The engine 100 further includes a starter 150, a cylinder 160, a cylinder head 170, and a rocker arm cover 180. Attached to the cylinder head 170 are an air exhaust port 190 shown in FIG. 1 and an air intake port 200 shown in FIG. 2. As is well known in the art, during operation of the engine 100, a piston 210 (see FIG. 7) moves back and forth within the cylinder 160 towards and away from the cylinder head 170. The movement of the piston 210 in turn causes rotation of a crankshaft 220 (see FIG. 7), as well as rotation of the fan 130 and the flywheel 140, which are coupled to the crankshaft. The rotation of the fan 130 cools the engine, and the rotation of the flywheel 140 causes a relatively constant rotational momentum to be maintained.

Referring specifically to FIG. 2, the engine 100 further includes an air filter 230 coupled to the air intake port 200, which filters the air required by the engine prior to the providing of the air to the cylinder head 170. The air provided to the air intake port 200 is communicated into the cylinder 160 by way of the cylinder head 170, and exits the engine by flowing from the cylinder through the cylinder head and then out of the air exhaust port 190. The inflow and outflow of air into and out of the cylinder 160 by way of the cylinder head 170 is governed by an input (intake) valve 240 and an output (exhaust) valve 250, respectively (see FIG. 9). Also as shown in FIG. 2, the engine 100 includes an oil filter 260 through which the oil of the engine 100 is passed and filtered. Specifically, the oil filter 260 is coupled to the crankcase 110 by way of incoming and outgoing lines 270, 280, respectively, whereby pressurized oil is provided into the oil filter and then is returned from the oil filter to the crankcase.

Figure 3:
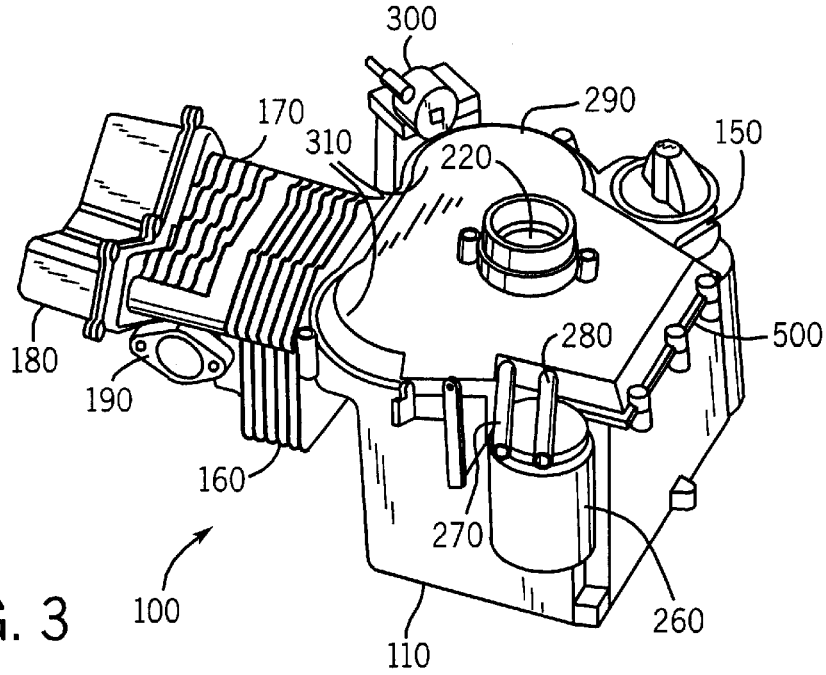
FIG. 3 is a third perspective view of the single cylinder engine of FIG. 1, in which certain parts of the engine have been removed to reveal additional parts of the engine.
Figure 4:
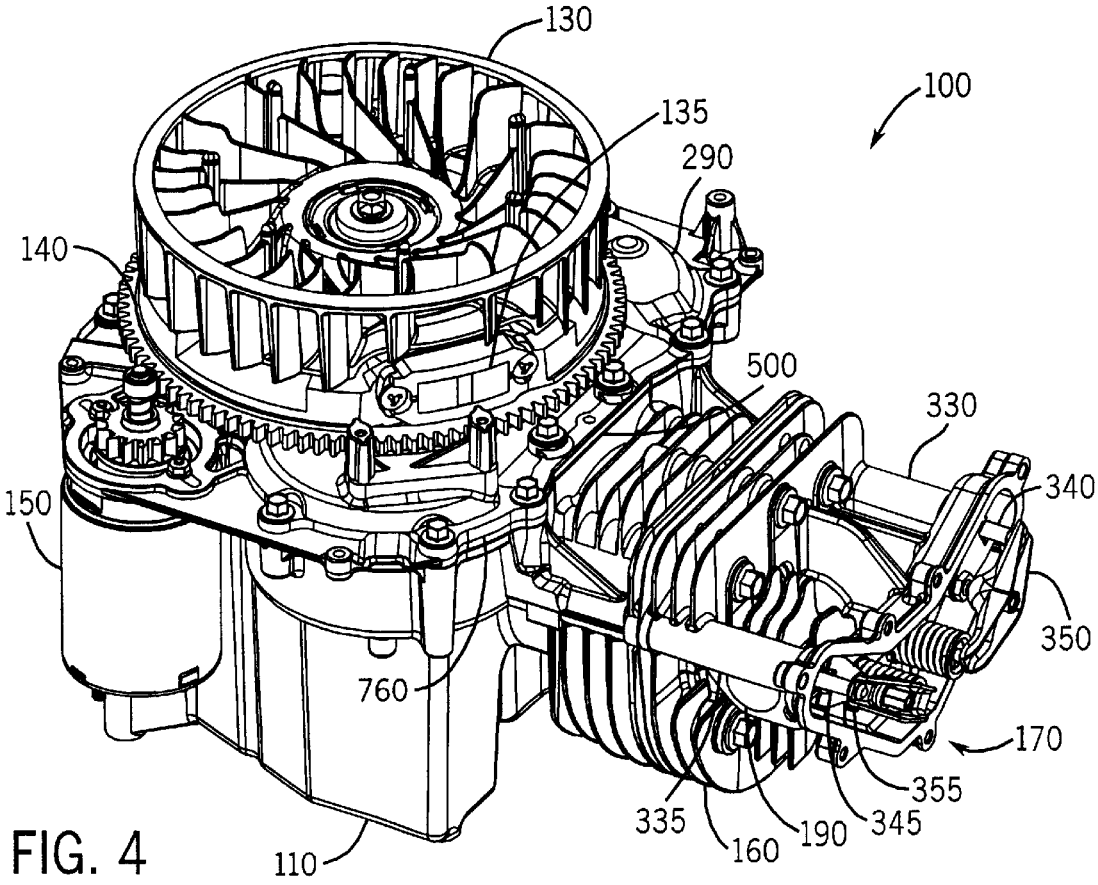
FIG. 4 is a fourth perspective view of the single cylinder engine of FIG. 1, in which certain parts of the engine have been removed to reveal additional parts of the engine.

Referring to FIGS. 3 and 4, the engine 100 is shown with the blower housing 120 removed to expose a top 290 of the crankcase 110. With respect to FIG. 3, in which both the fan 130 and the flywheel 140 are also removed, an ignition module 300 including a coil is shown that generates an electric current based upon rotation of a magnet 135 attached to the flywheel 140 (see FIG. 4). The coil 300 and magnet 135 together operate as a magneto. Additionally, the top 290 of the crankcase 110 is shown to have a pair of projections 310 that cover a pair of gears 320, 325 (see FIGS. 5, 7 and 9). FIG. 3 additionally shows the oil filter 260.

With respect to FIG. 4, the fan 130 and the flywheel 140 are shown above the top 290 of the crankcase 110. Additionally, FIG. 4 shows the engine 100 without the rocker arm cover 180, to more clearly reveal a pair of tubes 330,335 through which extend a pair of respective push rods 340,345. The push rods 340,345 extend between a pair of respective rocker arms 350,355 and a pair of cams 360,365 (see FIG. 9) within the crankcase 110, as discussed further below. FIG. 4 also shows the starter 150, and a gasket 760 that extends along a perimeter of the top 290, between the top and the remainder of the crankcase 110.

Figure 5:
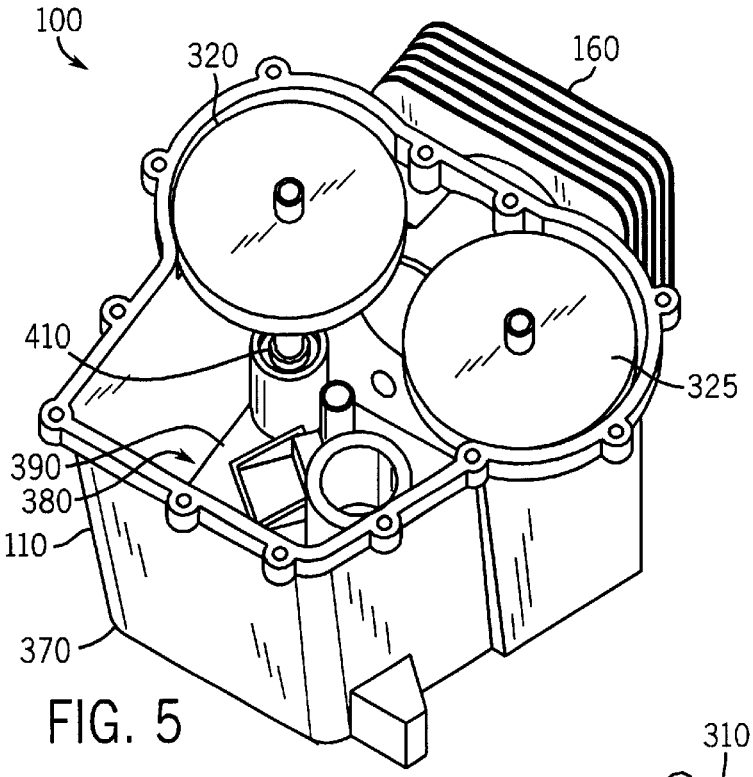
FIG. 5 is fifth perspective view of portions of the single cylinder engine of FIG. 1, in which a top of the crankcase has been removed to reveal an interior of the crankcase.
Figure 6:
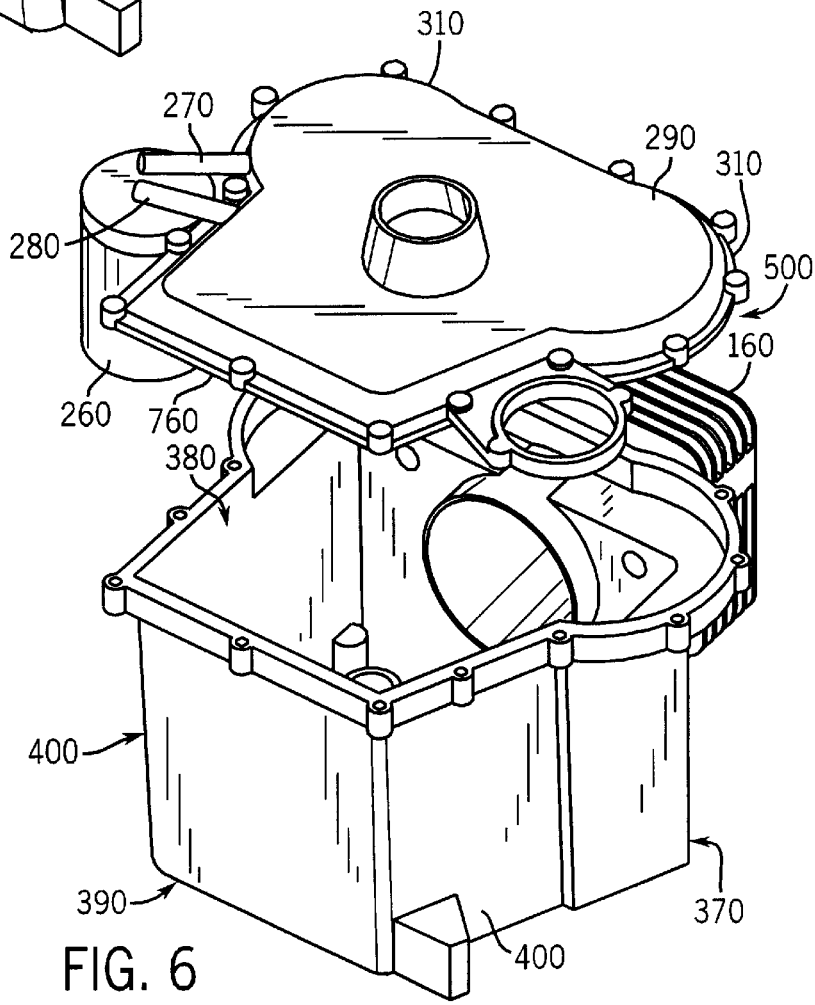
FIG. 6 is a sixth perspective view of portions of the single cylinder engine of FIG. 1, in which the top of the crankcase is shown exploded from the bottom of the crankcase.

Turning to FIGS. 5 and 6, the engine 100 is shown with the top 290 of the crankcase 110 removed from a bottom 370 of the crankcase 110 to reveal an interior 380 of the crankcase. Additionally in FIGS. 5 and 6, the engine 100 is shown in cut-away to exclude portions of the engine that extend beyond the cylinder 160 such as the cylinder head 170. With respect to FIG. 6, the top 290 of the crankcase 110 is shown above the bottom 370 of the crankcase in an exploded view. In this embodiment, the bottom 370 includes not only a floor 390 of the crankcase, but also all four side walls 400 of the crankcase, while the top 290 only acts as the roof of the crankcase.

The top 290 and bottom 370 are manufactured as two separate pieces such that, in order to open the crankcase 110, one physically removes the top from the bottom. The top 290 can be coupled to the bottom 370 by any of a variety of fastening mechanisms including, for example, screws, bolts, interlocking prongs and notches, etc., and the top and the bottom interface one another along a split line 500 (also shown in FIGS. 3 and 4). Upon assembly of the top 290 and the bottom 370, the top and the bottom are separated by the gasket 760, which exists along the split line 500. The top 290 is further discussed with reference to FIG. 8. Also, as shown in FIG. 5, the pair of gears 320,325 within the crankcase 110 are integrally formed as part of respective camshafts 410, 415, which in turn are supported by the bottom 370 and top 290 of the crankcase 110.

Figure 7:
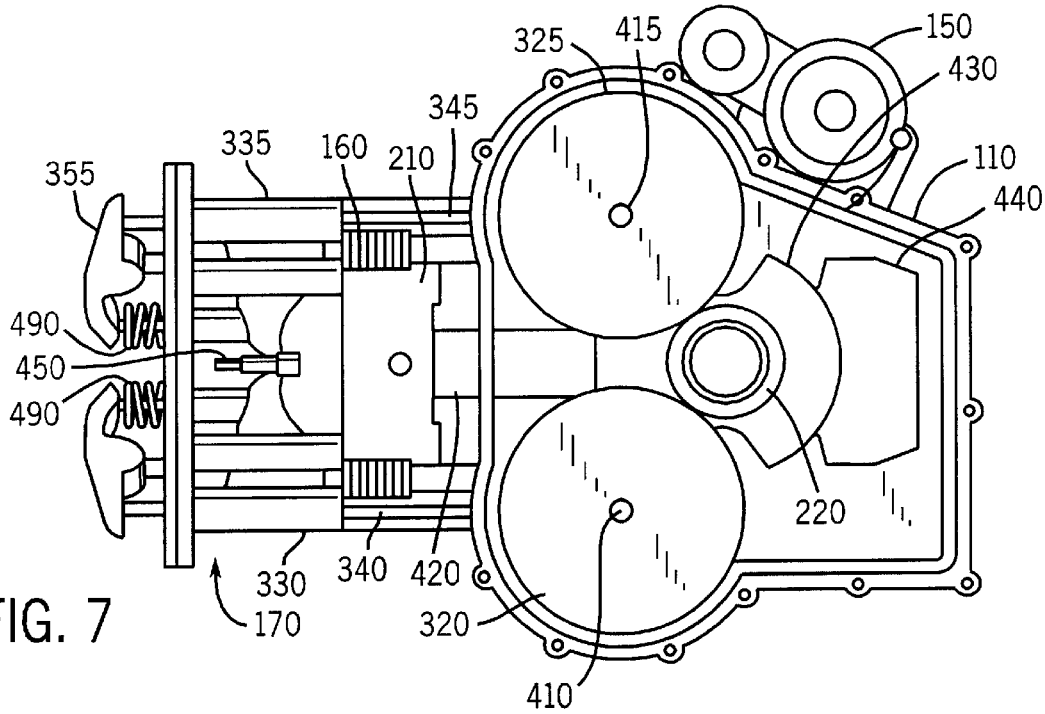
FIG. 7 is a top view of the single cylinder engine of FIG. 1, showing internal components of the engine.

Referring to FIG. 7, a top view of the engine 100 is provided in which additional internal components of the engine are shown. FIG. 7 shows a spark plug 450 located on the cylinder head 170, which provides sparks during power strokes of the engine to cause combustion to occur within the cylinder 160. The electrical energy for the spark plug 450 is provided by the coil 300 and the rotating magnet 135 (see FIGS. 3 and 4). Additionally, FIG. 7 shows the piston 210 within the cylinder 160 to be coupled to the crankshaft 220 by a connecting rod 420. The crankshaft 220 is in turn coupled to a rotating counterweight 430 and reciprocal weights 440, which balance the forces exerted upon the crankshaft 220 by the piston 210. The crankshaft 220 further is in contact with each of the gears 320,325 and thus communicates rotational motion to the gears. In the present embodiment, the camshafts 410,415 have internal channels by which oil or other lubricant can be communicated between the floor 390 of the crankcase 110 and the top 290 (see FIG. 5).

Figure 8:
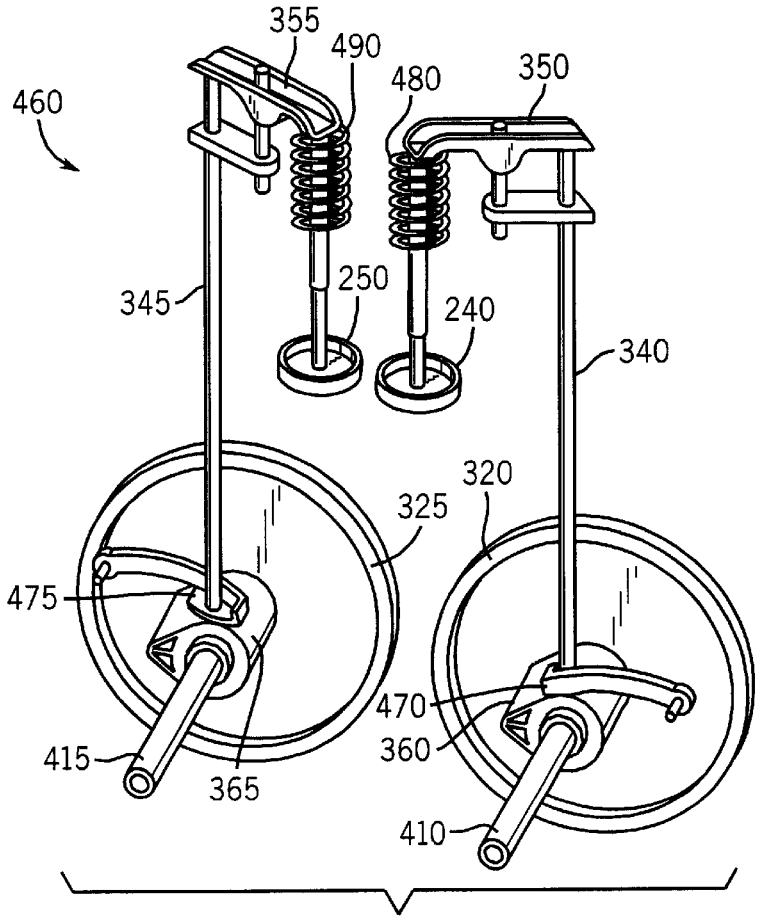
FIG. 8 is a perspective view of components of a valve train of the single cylinder engine of FIG. 1.

Referring to FIG. 8, and also to FIG. 7, elements of a valve train 460 of the engine 100 are shown. The valve train 460 includes the gears 320,325 resting upon the camshafts 410,415 and also includes the cams 360 underneath the gears, respectively. Additionally, respective cam follower arms 470,475 that are rotatably mounted to the crankcase 110 extend to rest upon the respective cams 360,365. The respective push rods 340,345 in turn rest upon the respective cam follower arms 470,475.

As the cams 360,365 rotate, the push rods 340,345 are temporarily forced outward away from the crankcase 110 by the cam follower arms 470,475. This causes the rocker arms 350,355 to rock (e.g., rotate about respective pivot points), and consequently causes the respective valves 240 and 250 to open toward the crankcase 110. As the cams 360,365 continue to rotate, however, the push rods 340,345 are allowed by the cam follower arms 470,475 to return inward to their original positions. A pair of springs 480,490 positioned between the cylinder head 170 and ends of the valves 240,250 proximate the rocker arms 350,355 provide force to close the valves 240,250, respectively. Further as a result of this forcing action of the springs 480,490 upon the valves 240,250, the rocker arms 350,355 and the push rods 340,345 are forced back to their original positions.

In the present embodiment, the engine 100 is a single cylinder vertical shaft internal combustion engine capable of outputting 15–20 horsepower for implementation in a variety of consumer lawn and garden machinery such as lawn mowers and lawn and garden tractors. In alternate embodiments, the engine 100 can also be implemented as a two-cylinder (or multiple cylinder) vertical shaft engine such as a V-twin engine or an inline twin cylinder engine, and/or be implemented in a variety of other types of machines. Further, in alternate embodiments, the particular arrangement of parts within the engine 100 can vary from those shown and discussed above. For example, in one alternate embodiment, the cams 360 could be located above the gears 320 rather than underneath the gears.

Returning to FIG. 6, the crankcase 110 with the removable top 290 has an inverted design relative to many conventional crankcases, in which the bottom is removable as an oil pan. Because the split line 500 of the crankcase 110 is between the top 290 and the sides 400 of the crankcase, rather than between the bottom (e.g., the bottom 370) and the sides as in other crankcases, oil collecting within the bottom of the crankcase 110 does not have a tendency to leak out of the crankcase along the split line.

Also, because the top 290 is removed rather than the bottom 370, parts of the engine 100 within the interior 380 are more easily accessed and serviced than in conventionally-designed engines. In particular, equipment such as belts and driven mechanisms (such as the blade of a lawnmower), which commonly are coupled to the crankshaft along the bottom of the engine below the bottom 370, need not be decoupled from the crankshaft 220 in order to access the inside of the crankcase 110. Rather, for the typical engine application in which the equipment driven by the engine is coupled to the engine along its bottom, the interior 380 of the crankcase 110 can be accessed simply by removing the top 290 of the crankcase, without removing the other equipment.

Figure 9:
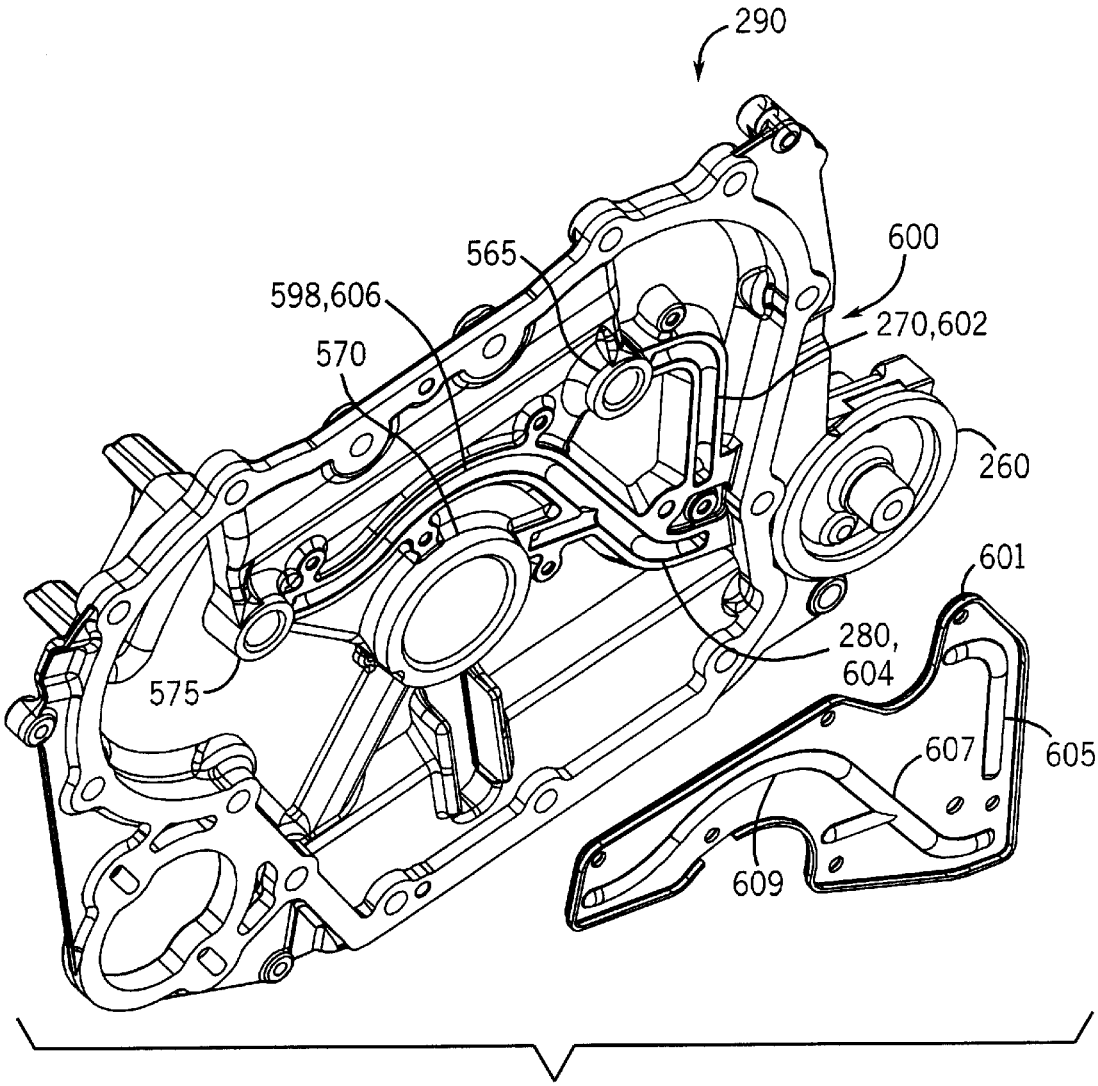
FIG. 9 is a perspective view of an interior side of the top of the crankcase of the single cylinder engine of FIG. 1, in which a panel to be affixed to the top has been exploded from the top.

Turning to FIG. 9, a perspective view of an interior side 600 of the top 290 of the crankcase 110 is provided to further clarify how the top 290 helps to form an oil circuit within the engine. The top 290 includes upper camshaft bearings 565,575 for supporting the respective camshafts 410,415 and an upper crankshaft bearing 570 for supporting the crankshaft 220. Also, the top 290 includes indentations 602 and 604 molded in the top 290 to form the incoming and outgoing lines 270 and 280, which respectively couple the upper camshaft bearing 565 with the oil filter 260 and couple the oil filter with the upper crankshaft bearing 570. Further shown is an additional indentation 606 molded in the top 290 to form an additional line 598, which extends the second indentation 604 to the upper camshaft bearing 575. The indentations 602,604 and 606 are semicircular in cross section, and the lines 270,280 and 598 are formed by covering the indentations with a panel 601.

In a preferred embodiment, oil is pumped up from the floor 390 of the crankcase through the camshaft 410 to the upper camshaft bearing 565, then to the oil filter 260 by way of the incoming line 270, and finally to the upper crankshaft bearing 570 and the upper camshaft bearing 575 by way of the outgoing and additional lines 280 and 598, respectively. Oil received at the upper camshaft bearing 575 is further communicated downward through the camshaft 415 to provide lubricant to a lower bearing of the camshaft (not shown). Depending upon the embodiment, oil can be communicated to these or other moving parts of the engine that require lubrication by different channels along the top 290.

Although the panel 601 can be flat, in the embodiment shown the panel has grooves 605,607 and 609 that complement the indentations 602,604 and 606 to form the lines 270,280 and 598, respectively. The panel 601 can be attached to the top 290 by way of screws or other fastening components or methods. The exact paths of the incoming and outgoing lines 270,280 shown in FIG. 8 are somewhat different than those shown in FIG. 7, insofar as the paths shown in FIG. 7 are straight while those of FIG. 8 are more curved. Thus, depending upon the embodiment, the incoming, outgoing, and additional lines 270,280 and 598 can follow a variety of different paths.

This manner of creating the lines 270,280 and 598 by way of molded indentations and the panel 601 is simpler and more cost-effective than alternative methods of creating oil passageways within the crankcase (e.g., casting enclosed channels through the use of cores, etc.), although the lines could be created using such other methods in alternate embodiments. The manufacture and assembly of the lines 270,280 in this manner is facilitated by the fact that the top 290 is removable, since the interior side 600 is more accessible than it would otherwise be in an engine where the bottom of the crankcase was removable instead of the top.

Figure 10:
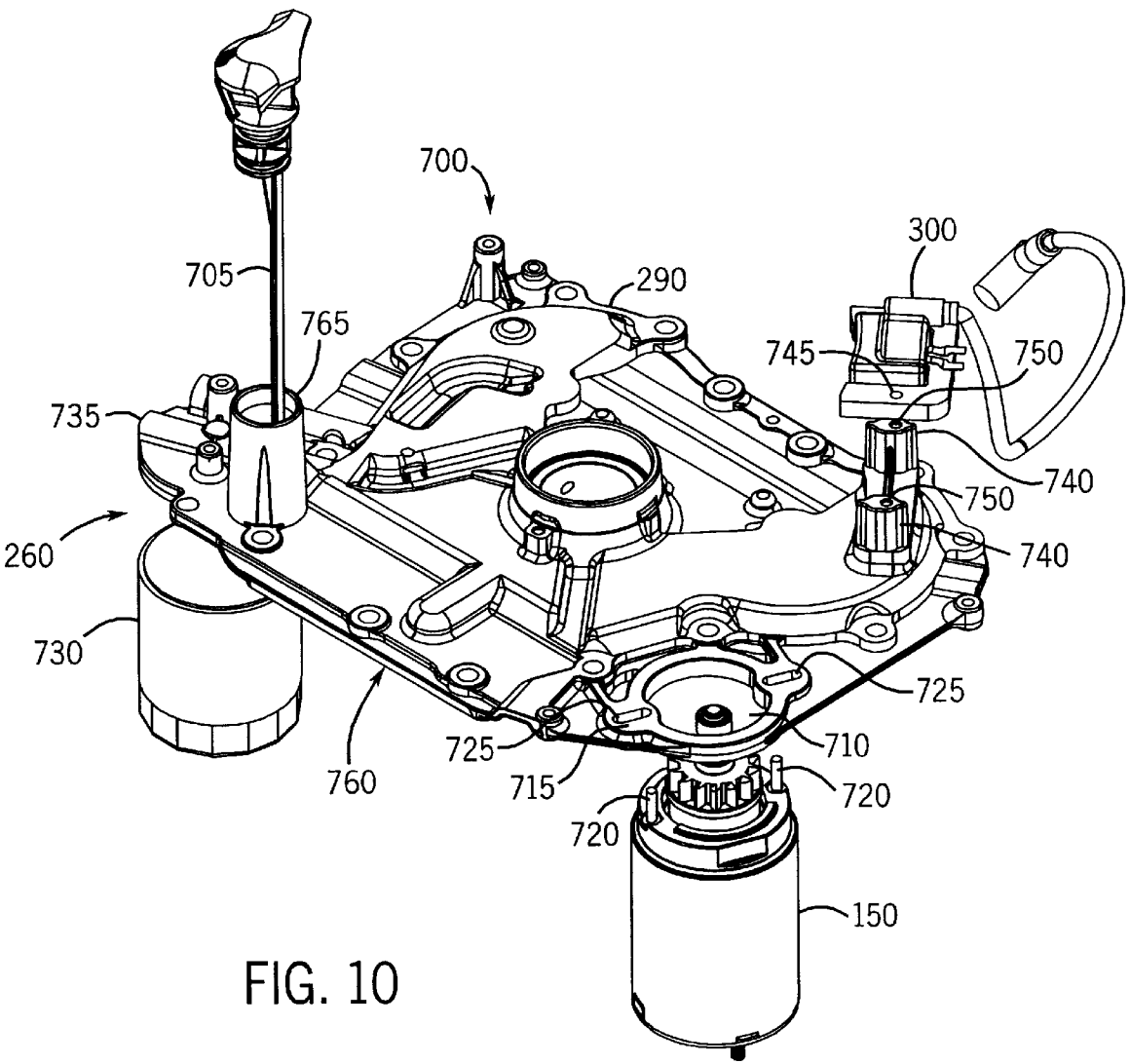
FIG. 10 is a perspective view of an exterior side of the top of the crankcase of the single cylinder engine of FIG. 1, disassembled from the oil filter, the ignition module and the electric starter of the engine.

As shown in FIGS. 3 and 4, in at least one embodiment of the engine 100, each of the oil filter 260, the electric starter 150, and the ignition module 300 are designed to be supported by and attached to the top 290 of the crankcase 110 rather than to some other portion of the crankcase. Referring additionally to FIG. 10, a perspective view of an exterior side 700 of the top 290 is provided with the oil filter 260, the electric starter 150, the ignition module 300 and a dipstick 705 associated with the oil filter 260 all disassembled from the top 290, in order to show how these different components are coupled to the top 290.

Further referring to FIG. 10, the oil filter 260 is located at the top 290 of the crankcase 110, and is further shown to be vertically-oriented and positioned high above the engine mounting plane. The oil filter 260 is also positioned so that, when the top 290 is assembled to the remainder of the crankcase, the oil filter is located substantially away from the neighboring one of the side walls 400. Because of its positioning, the oil filter 260 can be more easily changed or otherwise serviced than in conventional engines. In particular, it is easier for a technician to position an oil pan under the oil filter 260 during servicing of the oil filter than in conventional engines where the oil filter is positioned at the bottom of the crankcase. The entire oil filter 260 can also be removed along with the top 290 when the top is removed from the remainder of the crankcase 110. Indeed, because the removable top 290 is a relatively small piece that is easy for a technician to remove and handle, the oil filter 260 can be particularly easily serviced when the top is removed from the remainder of the crankcase 110.

The servicing of the oil filter 260 is additionally facilitated by the design of the oil filter. In particular, a cup-like bottom portion 730 of the oil filter 260 is shown to be matable with a top portion 735 of the oil filter that forms part of, and is molded integrally with the rest of, the top 290. Because the bottom portion 730 constitutes the major part of the oil filter 260, most of the oil held within the oil filter resides within the bottom portion. Thus, upon removing the bottom portion 730, most of the latent oil of the oil filter is removed with the bottom portion. Further, because the seal between the top portion 735 and the bottom portion 730 is proximate the top of the oil filter 260, relatively little oil (if any) tends to leak upon disassembly of the oil filter, since most of the oil is within the bottom portion.

Also as shown in FIG. 10, the dipstick 705 of the oil filter 260 fits into and through a tube 765 that is integrally formed as part of the top portion 735 of the oil filter and the top 290 of the crankcase 110. The dipstick 705 extends through the tube 765 into the bottom portion 730 of the oil filter 260 when the oil filter is completely assembled. Again because of the oil filter's location at the top 290 of the crankcase 110, and because the bottom portion 730 and the dipstick 705 are removable, proper operation of the dipstick is also relatively easy to observe in comparison with other oil filter designs implemented in other types of engines.

Still referring to FIG. 10, the electric starter 150 fits within a hole 710 formed within an extending flange 715 proximate one of the corners of the top 290. In the present embodiment, the electric starter 150 is coupled to the flange 715 by two bolts 720 that fit within corresponding slots 725 within the flange (and locked by way of corresponding nuts, not shown). Because the electric starter 150 can be attached directly to the top 290, no additional L-bracket is required to assemble the starter with the remainder of the engine 100. Consequently, assembly of the electric starter 150 to the rest of the engine 100 is simpler and more cost-effective than in conventional designs.

Further, the ignition module 300 is also shown to be couplable to the top 290, by way of a pair of bosses 740 that protrude out of the top. Specifically, a pair of screws (not shown) extend through corresponding holes 745 of the ignition module 300 and then into respective holes 750 of the bosses 740 to assemble the ignition module to the top. Because the ignition module 300 is positioned on the top 290 of the crankcase 110 rather than on the cylinder 160 or cylinder head 170, the ignition module is not exposed to as much heat as in many conventional engines. When the top 290 of the crankcase 110 is assembled to the bottom 370 of the crankcase, the gasket 760 is positioned between the top and the bottom. In a preferred embodiment, the gasket is made from a heat-resistant material such as a polymer. Therefore, in the present embodiment, the ignition module 300 is also protected from the heat given off by the cylinder 160/cylinder head 170 because the ignition module is positioned on the top 290 of the crankcase, which is insulated from the bottom 370 and thus insulated from the cylinder/cylinder head that are attached to the bottom of the crankcase.

In alternate embodiments, the top 290 need not be split from the remainder of the crankcase 110 exactly along the split line 500 that is shown in FIG. 6. Rather, the present invention is meant to encompass any crankcase design in which it is substantially an upper portion of the crankcase including at least a portion of the roof of the crankcase that is removable from the remainder of the crankcase, rather than substantially a lower portion of the crankcase including the floor of the crankcase. For example, in certain embodiments, the removable top of the crankcase is limited to include a portion of the top 290 that is shown in FIG. 6, and/or includes portions of the side walls 400.

Further, an inverted crankcase with a removable top is also applicable to other types of engines, such as twin cylinder or other multiple-cylinder engines. Also, while the crankcase 110 shown in FIGS. 1–6 is substantially cubic, in alternate embodiments of the invention, crankcases having different shapes can also be designed to have a removable top. For example, in one alternate embodiment, the crankcase could be substantially cylindrical in shape with the central axis of the cylinder being vertical. In such an embodiment, a portion or all of the circular top of the crankcase would be removable. In additional alternate embodiments, neither the bottom nor the top of the crankcase need be perfectly flat and horizontal. Indeed, in one alternate embodiment, the crankcase could have a substantially spherical shape, with the bottom of the crankcase being formed by substantially a bottom portion of the surface of the sphere, the removable top of the crankcase being formed by substantially a top portion of the surface of the sphere, and one or more sides of the crankcase being formed by the portions of the surface of the sphere in between the top and the bottom.

Although the embodiment of the engine 100 shown in FIGS. 1–10 shows an engine having each of the oil filter 260 (including the dipstick 705), the electric starter 150 and the ignition module 300 all coupled to the removable top 290, the present invention is intended to also encompass other embodiments in which certain (or even none) of these components are coupled to the removable top of the crankcase. For example, in an alternate embodiment, only the oil filter 260 is coupled to the removable top. Also, the present invention is intended to encompass engines that have a conventional crankcase but also have any of the oil filter, electric starter and the ignition module attached to the top of the crankcase. For example, the present invention is intended to encompass engines that have an oil filter coupled to the top of the engine, where the oil filter is vertically oriented and has a seam nearer to the top portion of the oil filter than the bottom portion of the oil filter. Although screws and bolts are discussed above as being used to assemble the electric starter 150 and the ignition module 300 to the top 290, in alternate embodiments, any conventional attachment components or technique can be employed to assemble the various engine components to one another.

While the foregoing specification illustrates and describes the preferred embodiments of this invention, it is to be understood that the invention is not limited to the precise construction herein disclosed. The invention can be embodied in other specific forms without departing from the spirit or essential attributes of the invention. Accordingly, reference should be made to the following claims, rather than to the foregoing specification, as indicating the scope of the invention.

What is claimed is:

1. A crankcase of an internal combustion engine, the crankcase comprising:

a top including at least a first portion of a top surface of the crankcase;

a bottom including a bottom surface of the crankcase and a plurality of side surfaces of the crankcase, wherein the side surfaces are substantially vertical and configured to extend between the top surface and the bottom surface;

first and second bearings within at least one of the top and bottom, wherein the first and second bearings are configured to support a crankshaft; and a first interface along at least one of the top surface, the bottom surface and the side surfaces at which the at least one surface is coupled to a first cylinder;

wherein the bottom and top interface one another along a split line, and wherein the top is removable from the bottom; and wherein the top is configured to be attached to at least one of an oil filter component, a starter, and an ignition module.

2. The crankcase of claim 1, wherein the top includes the entire top surface of the crankcase, and further includes a second portion of an additional side surface.

3. The crankcase of claim 1, wherein the crankcase has a substantially cubic shape, such that the top surface substantially forms a roof of the crankcase, the bottom surface substantially forms a floor of the crankcase, and the side surfaces include four surfaces that connect the bottom surface with the top surface.

4. The crankcase of claim 1, wherein the crankcase is at least one of substantially cylindrical in shape and substantially spherical in shape.

5. The crankcase of claim 1, wherein the top includes a first portion forming a top of an oil filter, and wherein the first portion is configured to be attached to the oil filter component, wherein oil of the oil filter resides primarily within the oil filter component.

6. The crankcase of claim 5, wherein the first portion includes a tube for receiving a dipstick.

7. The crankcase of claim 1, wherein at least first and second channels are formed along an interior surface of the top.

8. The crankcase of claim 7, wherein the crankcase further includes a panel that is attached to the interior surface of the top, wherein the first and second channels are formed by the panel and the interior surface.

9. The crankcase of claim 8, wherein the first and second channels respectively couple the second bearing and a third bearing with a top of an oil filter.

10. The crankcase of claim 1, wherein oil collects within the bottom, and further comprising fastening means for fastening the top to the bottom.

11. The crankcase of claim 1, wherein the first interface is a first orifice within one of the side surfaces and the crankshaft is to be positioned vertically with respect to the crankcase.

12. The crankcase of claim 1, wherein the crankcase is configured for receiving two cylinders.

13. The crankcase of claim 1, wherein the top is configured to be attached to the starter, and wherein the top includes a flange that includes an orifice within which the starter can be positioned.

14. The crankcase of claim 1, wherein the top is configured to be attached to the ignition module, wherein the top includes a pair of bosses for supporting the ignition module.

15. The crankcase of claim 14, further comprising a gasket at the split line that insulates the top from the bottom and further insulates the ignition module from heat transmitted to the bottom from the first cylinder.

16. An internal combustion engine comprising:

a crankshaft including first and second main portions, a crank pin, and first and second crank arms coupling the crank pin to the first and second main portions, respectively;

a cylinder head;

a cylinder coupled to the cylinder head;

a piston positioned within the cylinder and coupled to the crank pin by a connecting rod;

an additional engine component including at least one of an oil filter component, a starter, and an ignition module;

a bottom portion of a crankcase, wherein the bottom portion includes at least one bearing for supporting the crankshaft and is further coupled to the cylinder; and removable top means for encasing at least a portion of the crankshaft, wherein the removable top means is capable of being attached to the bottom portion, and wherein the additional engine component is attached to the removable top means.

17. The internal combustion engine of claim 16, wherein the additional engine component is a vertically-oriented oil filter component attached to the removable top means, wherein the oil filter component is mounted so as to be above an engine mounting plane, and is positioned so as to be situated apart from an additional side of at least one of the bottom portion and the removable top means.

18. The internal combustion engine of claim 17, wherein the removable top means includes a top portion of an oil filter that is matable to the oil filter component.

19. The internal combustion engine of claim 16, wherein the additional engine component is one of an ignition module and a starter.

20. A method of assembling a crankcase of an internal combustion engine, the method comprising:

providing a bottom of a crankcase coupled to a cylinder, wherein a piston is positioned within the cylinder, a crankshaft is supported by the bottom of the crankcase, and the piston is coupled to the crankshaft by a connecting rod;

affixing a top of the crankcase to the bottom of the crankcase, wherein the top includes at least a first portion of a top surface of the crankcase, and wherein the bottom of the crankcase includes a bottom surface of the crankcase and at least one side surface of the crankcase; and attaching at least one of an oil filter component, a starter and an ignition module to the top of the crankcase.

21. The method of claim 20, wherein the affixing of the top includes fastening a plurality of fasteners to couple the top to the bottom of the crankcase, wherein the top is capable of being removed and reattached, and wherein a gasket is positioned in between the top and the bottom.

22. A crankcase of an internal combustion engine, the crankcase comprising:

a top including at least a first portion of a top surface of the crankcase;

a bottom including a bottom surface of the crankcase and a plurality of side surfaces of the crankcase, wherein the side surfaces are substantially vertical and configured to extend between the top surface and the bottom surface, wherein the bottom and top interface one another along a split line, and wherein the top is removable from the bottom and wherein at least one channel is formed along an interior surface of the removable top.

* * * * *